US009322513B2

(12) United States Patent
Ryeol

(10) Patent No.: US 9,322,513 B2
(45) Date of Patent: Apr. 26, 2016

(54) LIGHTING APPARATUS USING WHITE-LIGHT LEDS

(75) Inventor: Kim Soo Ryeol, Seoul (KR)

(73) Assignee: LUMIGREEN CO., LTD., Sungman-Si (KR)

( * ) Notice: Subject to any disclaimer, the term of this patent is extended or adjusted under 35 U.S.C. 154(b) by 824 days.

(21) Appl. No.: 13/079,550

(22) Filed: Apr. 4, 2011

(65) Prior Publication Data

US 2011/0248641 A1 Oct. 13, 2011

(30) Foreign Application Priority Data

Apr. 9, 2010 (KR) ..... 10-2010-32683

(51) Int. Cl.

| | |
|---|---|
| ***F21S 4/00*** | (2006.01) |
| ***F21V 21/00*** | (2006.01) |
| ***F21K 99/00*** | (2016.01) |
| ***F21S 6/00*** | (2006.01) |
| *F21Y 101/02* | (2006.01) |
| *F21Y 113/00* | (2016.01) |

(52) U.S. Cl.

CPC ... *F21K 9/00* (2013.01); *F21K 9/13* (2013.01); *F21S 6/003* (2013.01); *F21Y 2101/02* (2013.01); *F21Y 2113/005* (2013.01)

(58) Field of Classification Search

CPC ..... F21K 9/00; F21K 9/13; F21S 6/003; F21S 4/008; F21Y 2113/005; F21Y 2101/02; F21Y 2111/007; F21Y 2103/003; F21Y 2105/001; F21Y 2105/008; H05B 33/0815; H05B 37/02; H05B 33/0803; F21W 2121/00; F21V 29/004; F21V 23/003; F21V 9/08; H01L 25/0753; H01L 2924/12041; H01L 24/97; A61B 2019/521; A61B 1/0684; Y10S 362/80; A42B 3/004; A61L 2209/12; B60Q 1/1423; B60Q 1/2607; H04B 10/502; A47F 3/001; A61C 1/088; G02B 6/0061; G02B 6/0068; G02F 1/133615; G02F 2001/133616; G03G 15/04054; G03G 15/326; G09F 9/33; G09F 13/0404; H01R 13/7175

USPC ..... 362/800, 1, 2, 11, 611, 612, 613, 555, 362/583, 508, 509, 510, 543, 545, 227, 230, 362/231, 235, 249.02, 249.03, 249.04, 362/311.02

See application file for complete search history.

(56) References Cited

U.S. PATENT DOCUMENTS

| | | | | |
|---|---|---|---|---|
| 5,803,579 | A * | 9/1998 | Turnbull et al. | 362/516 |
| 6,683,423 | B2 * | 1/2004 | Cunningham | 315/312 |
| 8,025,424 | B2 * | 9/2011 | Mondloch et al. | 362/249.02 |
| 2004/0218387 | A1 * | 11/2004 | Gerlach | 362/231 |

(Continued)

*Primary Examiner* — Stephen F Husar
*Assistant Examiner* — Danielle Allen
(74) *Attorney, Agent, or Firm* — Birch, Stewart, Kolasch & Birch, LLP

(57) ABSTRACT

Disclosed herein is a lighting apparatus using white-light Light-Emitting Diodes (LEDs). The lighting apparatus includes white-light LEDs, first LEDs, second LEDs, a substrate, a driving unit, and wires. The white-light LEDs emit light having a first peak value in a wavelength range of about 440 to 460 nm and a second peak value in a wavelength range of about 520 to 600 nm as a main light source. The first LEDs emit light having a third peak value in a wavelength range of about 610 to 625 nm as an auxiliary light source. The second LEDs emit light having a fourth peak value in a wavelength range of about 492 to 500 nm as an auxiliary light source. The substrate allows the LEDs to be disposed thereon. The driving unit drives the LEDs. The wires connect the substrate to the driving unit.

11 Claims, 10 Drawing Sheets

(56) References Cited

U.S. PATENT DOCUMENTS

2005/0135079 A1* 6/2005 Yin Chua et al. ..... 362/12
2008/0165535 A1* 7/2008 Mazzochette ..... 362/294
2009/0046453 A1* 2/2009 Kramer ..... 362/231
2010/0118510 A1* 5/2010 Bailey et al. ..... 362/84
2010/0327752 A1* 12/2010 Tamura ..... 315/113

* cited by examiner

LIGHTING APPARATUS USING WHITE-LIGHT LEDS

BACKGROUND OF THE INVENTION

1. Field of the Invention

The present invention relates generally to a lighting apparatus using white-light Light-Emitting Diodes (LEDs), and, more particularly, to a lighting apparatus that is capable of additionally outputting light of wavelengths which is not output by a lighting apparatus using white-light LEDs and which is used to enable the human optic nerves to perform their optic functionality under natural light conditions, thereby improving both color rendering and sharpness.

2. Description of the Related Art

Fluorescent lamp lighting apparatuses are being widely used as the main lighting apparatuses of public facilities or homes. Recently, various types of lighting apparatuses using LEDs, which have half the power consumption of the fluorescent lamp lighting apparatuses, have been developed and widely used.

Meanwhile, since natural light (solar light) has a wide wavelength distribution of 380 to 780 nm and human eyesight is adapted to natural light, humans feel comfortable and, also, human eyesight can be protected when humans view objects that are illuminated with natural light.

Furthermore, it is important to make the color of the light of a lighting apparatus approximate the light color under natural light conditions by improving color rendering representative of the extent of approximating color under natural light conditions.

Therefore, conventional lighting apparatuses using LEDs have attempted to improve color rendering by combining other LEDs having various wavelengths so that the light emitted by the total LEDs can approximate natural light. However, since it is difficult to manufacture LEDs having various wavelengths due to their cost and the yields of manufacturing processes, it is common to construct lighting apparatuses using a plurality of white-light LEDs which are advantageous in terms of both manufacturing cost and yield. Such white-light LEDs are manufactured chiefly by combining blue LEDs with yellow phosphor.

Here, the white-light LEDs have a spectral distribution such as that shown in FIG. 1, and generally emit light having a first peak value in a wavelength range of about 440 to 460 nm and a second peak value in a wavelength range of about 520 to 600 nm.

However, such white-light LEDs have poor color rendering (at a level at which the Color Rendering Index (CRI) thereof is 65-75) and low sharpness because there are many wavelengths which exist in natural light but are not emitted by the white-light LEDs.

SUMMARY OF THE INVENTION

Accordingly, the present invention has been made keeping in mind the above problems occurring in the prior art, and an object of the present invention is to provide a lighting apparatus which is capable of improving both color rendering and sharpness while utilizing inexpensive white-light LEDs as a main light source.

In order to accomplish the above object, one aspect of the present invention provides a lighting apparatus using white-light LEDs, including white-light LEDs for emitting light having a first peak value in a wavelength range of about 440 to 460 nm and a second peak value in a wavelength range of about 520 to 600 nm as a main light source; first LEDs for emitting light having a third peak value in a wavelength range of about 610 to 625 nm as an auxiliary light source in order to improve color rendering; second LEDs for emitting light having a fourth peak value in a wavelength range of about 492 to 500 nm as an auxiliary light source in order to improve sharpness; a substrate for allowing the white-light LEDs, the first LEDs, and the second LEDs to be disposed thereon; a driving unit for driving the white-light LEDs, the first LEDs, and the second LEDs; and wires for connecting the substrate to the driving unit.

In order to accomplish the above object, another aspect of the present invention provides an LED lamp using white-light LEDs, including a base configured to receive Alternating Current (AC) power; white-light LEDs disposed on a lower surface of the LED lamp, and configured to emit light having a first peak value in a wavelength range of about 440 to 460 nm and a second peak value in a wavelength range of about 520 to 600 nm as a main light source; first LEDs disposed on the lower surface of the LED lamp, and configured to emit light having a third peak value in a wavelength range of about 610 to 625 nm as an auxiliary light source in order to improve color rendering; second LEDs disposed on the lower surface of the LED lamp, and configured to emit light having a fourth peak value in a wavelength range of about 492 to 500 nm as an auxiliary light source in order to improve sharpness; a driving unit configured to drive the white-light LEDs, the first LEDs, and the second LEDs; and a substrate configured such that terminals of the white-light LEDs, the first LEDs and the second LEDs and the driving unit are disposed thereon and AC power is supplied by the base thereto.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
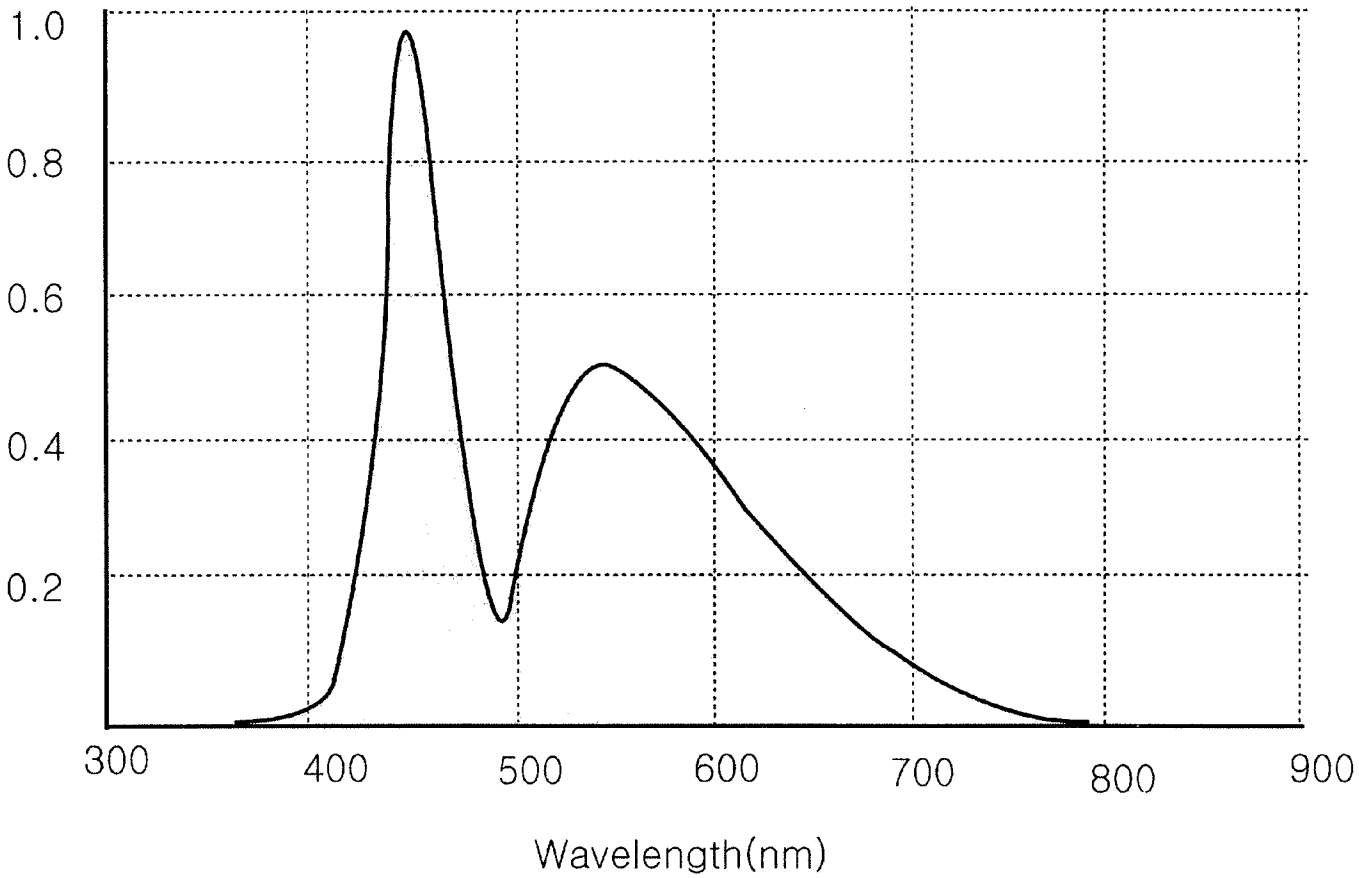
FIG. 1 is a diagram showing an embodiment of the distribution of wavelengths of white-light LEDs.

Reference now should be made to the drawings, in which the same reference numerals are used throughout the different drawings to designate the same or similar components.

Since using LEDs with various wavelengths in order to improve the color rendering of white-light LEDs (also known as "white LEDs" having a spectral distribution as shown in FIG. 1 is disadvantageous in that it is difficult to manufacture LEDs with various wavelengths and the manufacturing cost and yield thereof are undesirable as described above, it is preferable to use LEDs having only special wavelengths, which considerably affect color rendering, as an auxiliary light source while using white-light LEDs, which are excellent in yield and unit cost because they are inexpensive and the manufacturing process thereof is simple, as a main light source, thereby improving color rendering as a whole. In the present disclosure, white-light LEDs mean white LEDs which are known to be composed mainly by combining blue LEDs with yellow phosphor.

Furthermore, in the field of lighting apparatuses, sharpness as well as color rendering is important. To be a desirable lighting apparatus, the sharpness of the lighting apparatus as well as the color rendering thereof should be improved.

Meanwhile, according to the investigation of the inventor of the present invention, the result that the CRI was considerably improved by adding auxiliary light source LEDs having a peak value in a wavelength range of about 610 to 625 nm to main light source white-light LEDs was obtained by CRI simulation.

In particular, CRI simulation showed that adding a combination of auxiliary light source LEDs having a peak value in a wavelength range of about 610 to 625 nm and auxiliary light source LEDs having a peak value in a wavelength range of about 492 to 500 nm to white-light LEDs resulted in improving the CRI slightly further up to about 92 or higher (in FIGS. 3 and 4, CRI simulation values are illustrated as being 94.96 and 96.57, respectively), and the sharpness as observed by the naked eye was considerably improved. As a result, the inventor come to the conclusion that such a combination of white-light LEDs and such types of auxiliary light source LEDs is the optimum combination that is capable of improving both color rendering and sharpness.

Figure 2:
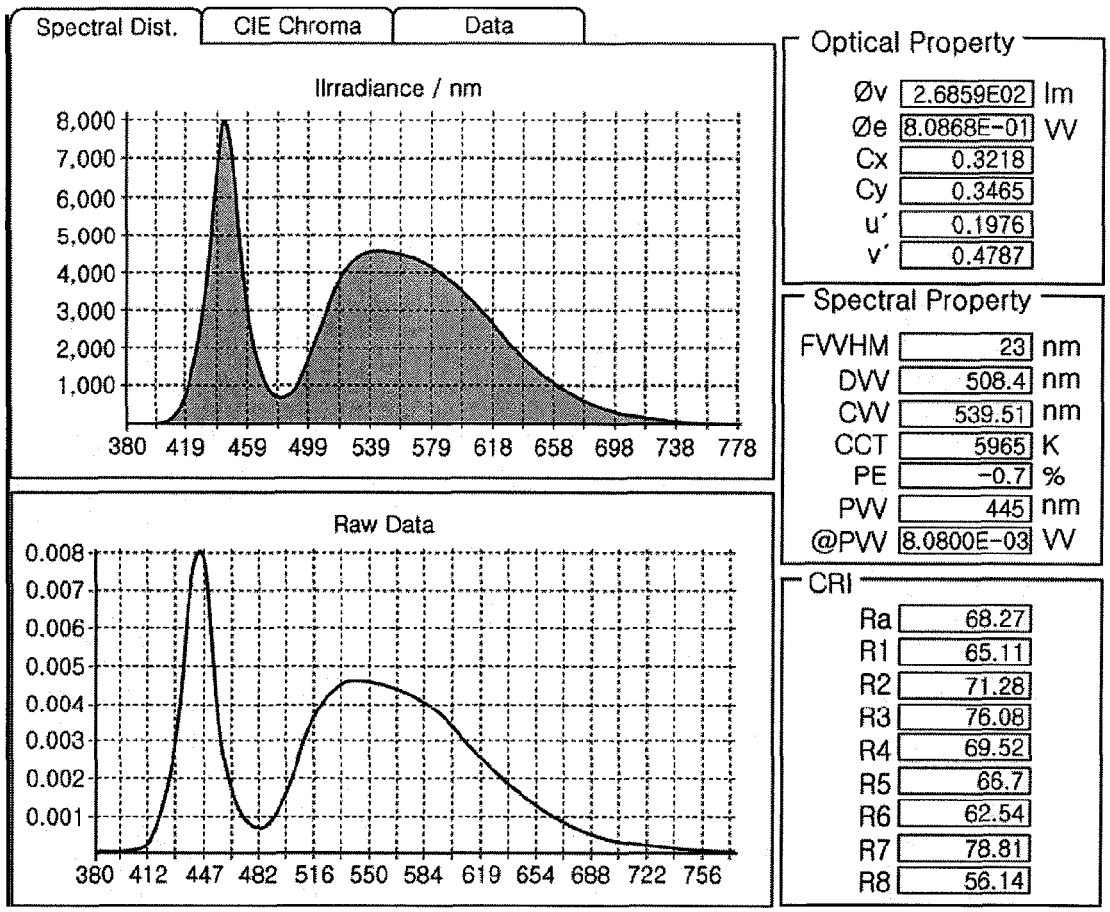
FIG. 2 shows screen captures showing the color rendering simulation results of the distribution of wavelengths of white-light LEDs.

Referring to FIG. 2 in detail, the graphs are screen captures which are obtained using a CRI simulator. In the upper graph of this drawing, the distribution of the wavelengths of white-light LEDs is represented by using gray color. In the lower graph thereof, the distribution of wavelengths is represented using a full line. From the lower graph, it can be seen that this distribution of wavelengths is similar to the distribution of wavelengths shown in the graph of FIG. 1.

Figure 3:
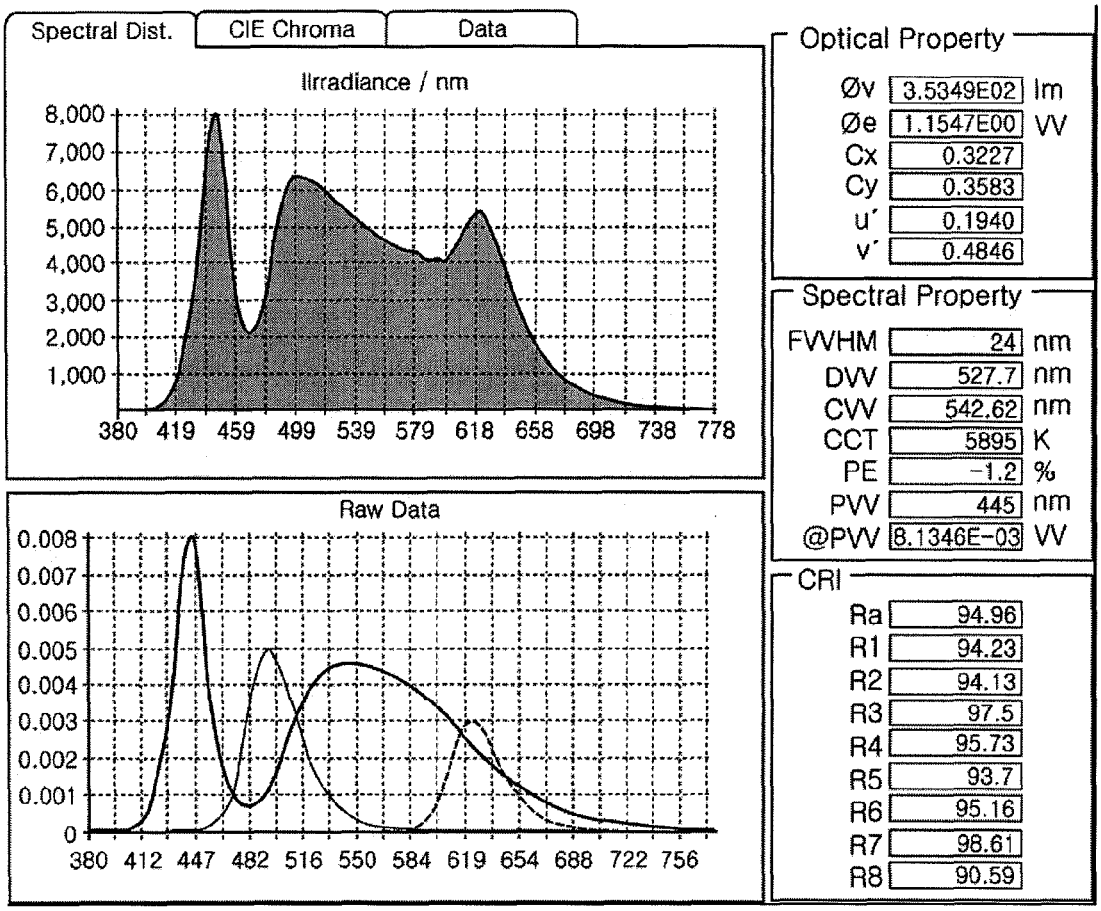
FIGS. 3 and 4 are graphs showing the distributions of wavelengths that were obtained by a color rendering simulator when LEDs with wavelengths in a range of about 492 to 500 nm and LEDs with wavelengths in a range of about 610 to 625 nm were added to white-light LEDs, in the present invention.

FIG. 3 shows a simulation result in which when the distribution of wavelengths of LEDs (thin full line) having a peak value in a wavelength range of about 492 to 500 nm and the distribution of wavelengths of LEDs (dotted line) having a peak value in a wavelength range of about 610 to 625 nm were added to the distribution of wavelengths of white-light LEDs (thick full line), a CRI (Ra) of 94.96 was obtained, as shown in the lower graph.

Figure 4:
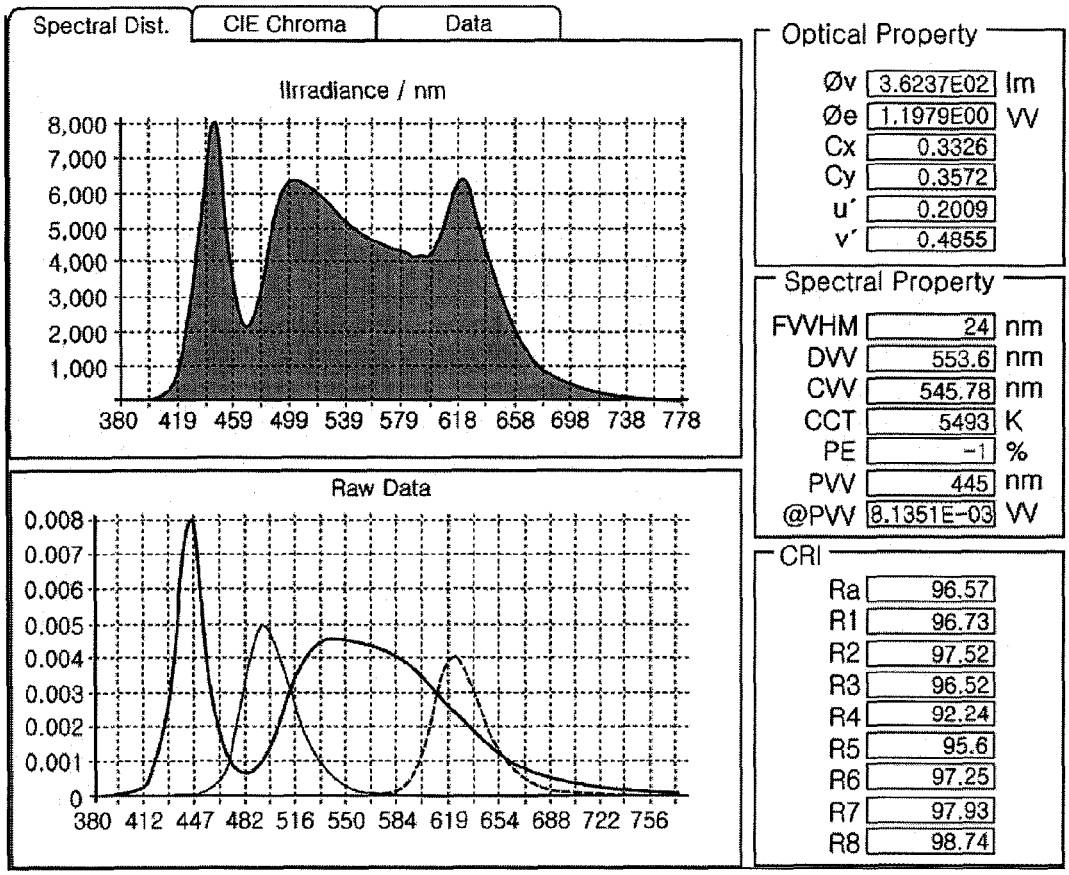

FIG. 4 shows a simulation result in which when more LEDs (dotted line) having a peak value in a wavelength range of about 610 to 625 nm were used, unlike in FIG. 3, a CRI (Ra) of 96.57 was obtained.

Here, in order to improve the sharpness of a lighting apparatus which emits small quantities of wavelengths in a wavelength range of about 492 to 500 nm, it is necessary to increase illuminance to bring about higher brightness, which requires higher power consumption. Since a lighting apparatus which emits an appropriate amount of light of wavelengths in a range of about 492 to 500 nm can achieve a sharpness identical to that at higher illuminance at higher power consumption, these wavelengths are the core wavelengths in the present invention.

Accordingly, in order to improve both color rendering and sharpness, the lighting apparatus according to the present invention uses white-light LEDs as a main light source and additionally uses LEDs having a peak value in a wavelength range of about 492 to 500 nm and LEDs having a peak value in a wavelength range of about 610 to 625 nm as an auxiliary light source.

Here, the LED lighting apparatus according to the present invention may be applied not only to movable lighting apparatuses (for example, fluorescent lamp-type desk lamps widely used in study rooms, and incandescent lamp-type floor lamps widely used in western countries) but also to stationary lighting apparatuses (for example, fluorescent lamp-type square and circular lamps widely used as bedroom lamps and/or living room lamps).

Now, the case where the present invention has been applied to a fluorescent lamp-type desk lamp will be described with reference to FIGS. 5 to 7.

Figure 5:
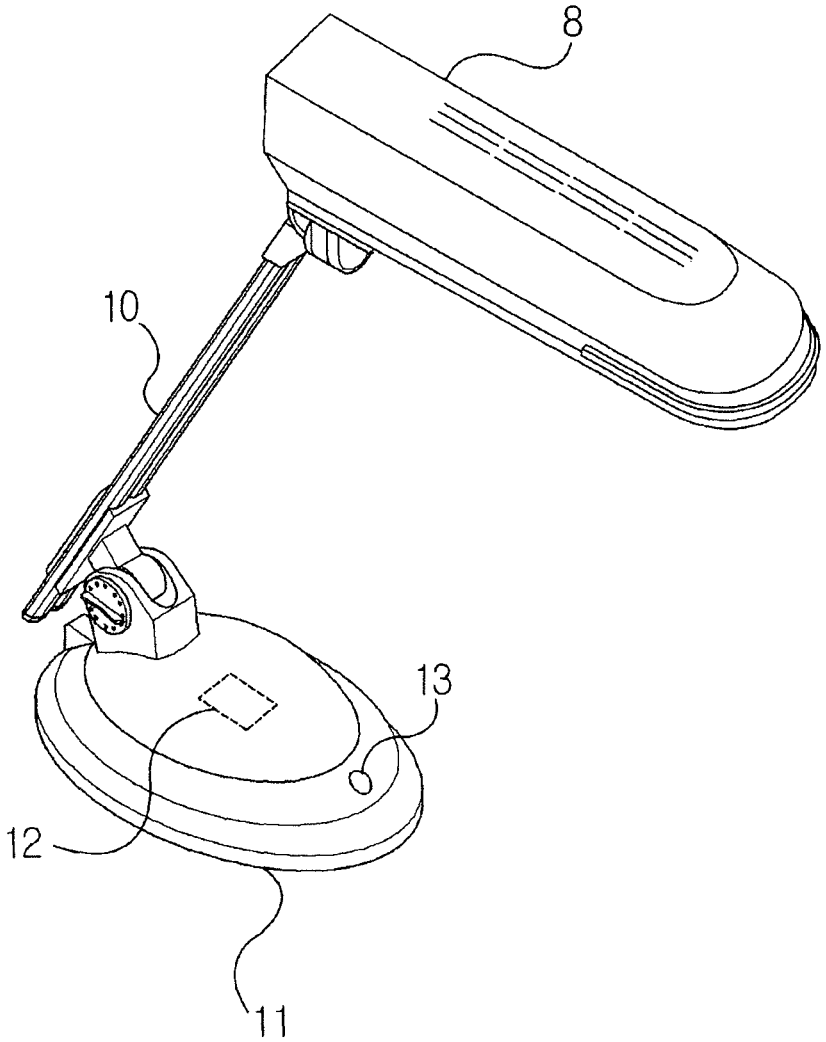
FIG. 5 is a perspective view showing a desk lamp to which the present invention has been applied.
Figure 6:
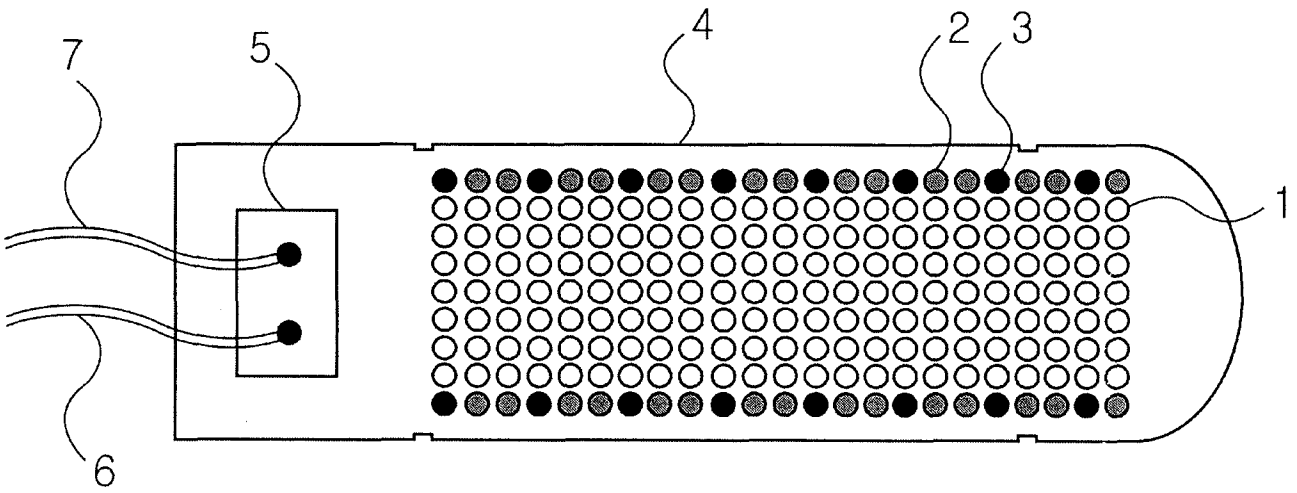
FIG. 6 is a diagram showing the structure of a substrate that is used to apply the present invention to a desk lamp.

FIG. 5 illustrates the fluorescent lamp-type desk lamp according to the present invention. A substrate 4, such as that shown in FIG. 6, is disposed inside a lampshade 8, and white-light LEDs 1, LEDs 2 having a peak value in a wavelength range of about 492 to 500 nm, and LEDs 3 having a peak value in a wavelength range of about 610 to 625 nm are appropriately arranged on the substrate 4. Here, the LEDs 1, 2 and 3 are disposed in various arrangements, such as in an alternate arrangement or in an arrangement in which the same type of LEDs are arranged in the same row (for example, in FIG. 6, the white-light LEDs 1 are arranged in the center portions, and the LEDs 2 having a peak value in a wavelength range of about 492 to 500 nm and the LEDs 3 having a peak value in a wavelength range of about 610 to 625 nm are arranged in a row above the center portion and a row below the center portion). An appropriate number of LEDs 2 and 3 are used depending on the intensity of the light of all the white-light LEDs 1 and the intensity of the light of each LED 2 or 3.

Furthermore, substrate wiring (not shown) for supplying power for driving the LEDs 1, 2 and 3 is disposed on the back of the substrate 4, and the substrate wiring is connected to wires 6 and 7 on a substrate wiring connection part 5.

Figure 7:
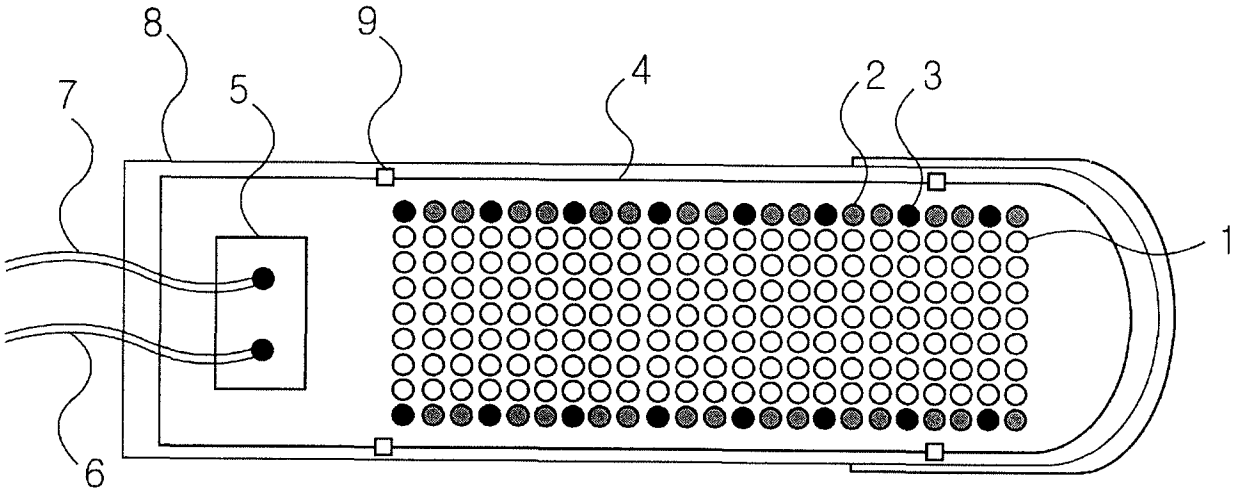
FIG. 7 is a diagram showing a structure in which the substrate of FIG. 6 is fastened to a lampshade.

Thereafter, the lampshade 8 according to the present invention is formed by fastening the substrate 4 to the lampshade 8 using one or more screws or by fastening the substrate 4 by inserting it into an elastic locking structure 9 disposed on the lampshade 8, as shown in FIG. 7. The desk lamp according to the present invention is formed by combining the lampshade 8 with an extendable member 10 (through which the wires 6 and 7 pass through) and the base 11, as shown in FIG. 5.

Here, a driving unit 12 for LEDs 1, 2 and 3 is mounted in the base 11, and the output of the driving unit 12 is connected to the wires 6 and 7.

Now, when a user applies domestic AC power to the driving unit 12 in the base 11 by turning on a switch 13, the output of the driving unit 12 is supplied to the LEDs 1, 2 and 3 through the wirings 6 and 7.

Figure 8:
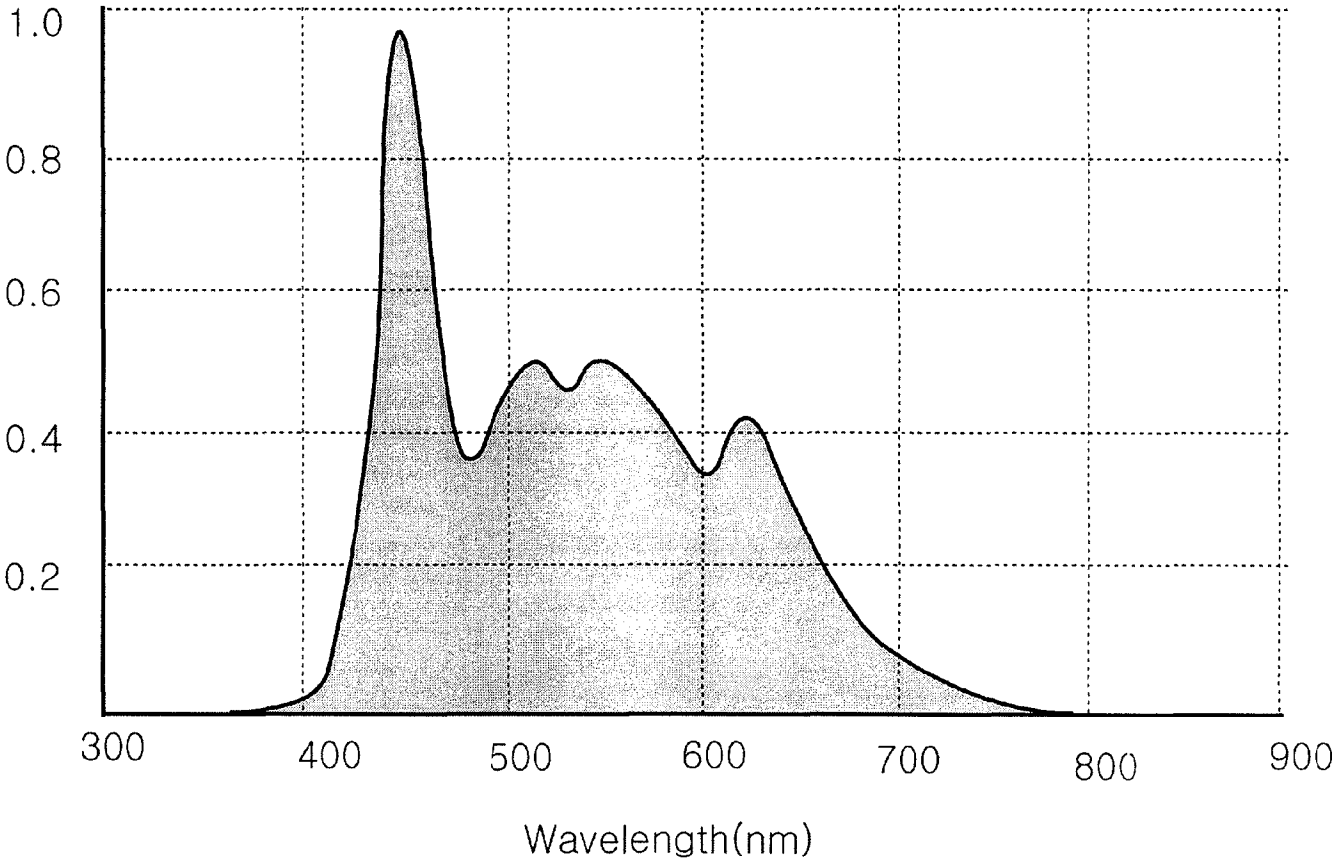
FIG. 8 is a diagram showing the distribution of wavelengths that is obtained when the present invention is applied.

That is, when a user turns on the switch 13, the LEDs 1, 2 and 3 are all turned on. The white-light LEDs 1 emit light having a wavelength distribution such as that shown in FIG. 1, the LEDs 2 emit light having a peak value in a range of about 492 to 500 nm, and LEDs 3 emit light having a peak value in a range of about 610 to 625 nm. As a whole, a lighting apparatus using white-light LEDs having a wavelength distribution, such as that shown in FIG. 8, is formed.

Furthermore, when an anti-glare filter is additionally attached to the lampshade 8 of FIG. 5, glaring can be prevented.

Furthermore, although the desk lamp has been described as an example of the movable lighting apparatus, the present invention may be applied to the case where such a substrate is mounted in a built-in square or circular lamp installed in a living room or a bedroom or a streetlamp or security lamp installed on an outdoor street, which is a stationary lighting apparatus.

Thereafter, an incandescent lamp-type LED lighting apparatus formed by applying the principle of the present invention to an LED lamp having an incandescent lamp-type socket will be described with reference to FIGS. 9 and 10.

Since the incandescent lamp-type LED lighting apparatus of the present invention is formed by screwing the LED lamp (which is usually covered with a transparent or translucent protective cover), such as that shown in FIGS. 9 and 10, into an existing incandescent lamp-type lighting apparatus, only the LED lamp unique to the present invention will be described in detail below.

The LED lamp 20 is screwed into the incandescent lamp socket (fastening structure) of the incandescent lamp-type lighting apparatus by means of a metallic base 21, and is connected to an AC power source.

Furthermore, a plurality of LEDs 23, 24 and 25 is arranged at the lower end of the LED lamp 20.

Figure 9:
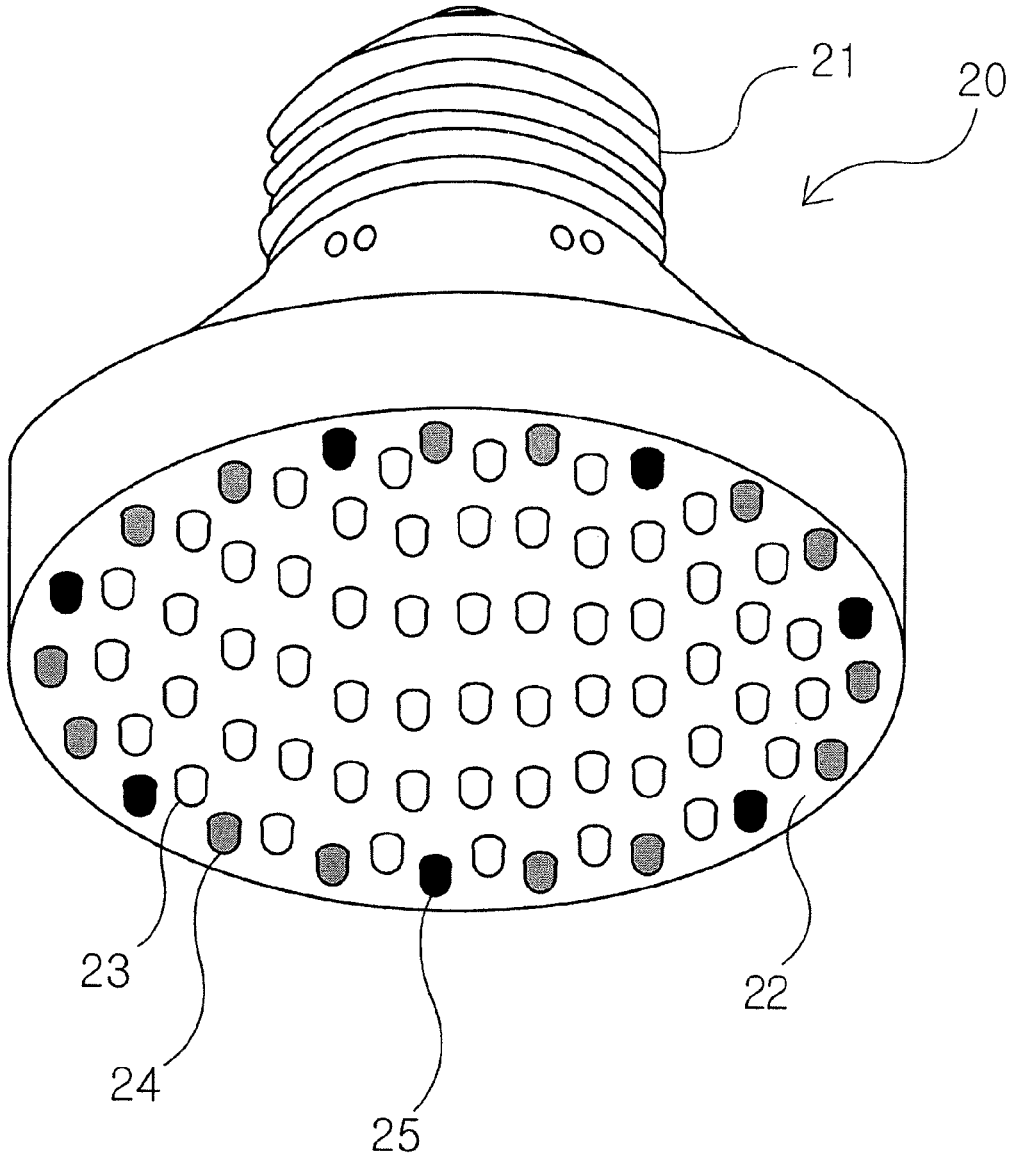
FIG. 9 is a perspective view of an incandescent lamp-type LED lighting apparatus to which the present invention has been applied.

Although in FIG. 9, the white-light LEDs 23 are illustrated as being arranged on the center portion and the LEDs 24 having a peak value in a wavelength range of about 492 to 500 nm and the LEDs 25 having a peak value in a wavelength range of about 610 to 625 nm are illustrated as being arranged in the outer portion, they may be disposed in various arrangements as needed.

Figure 10:
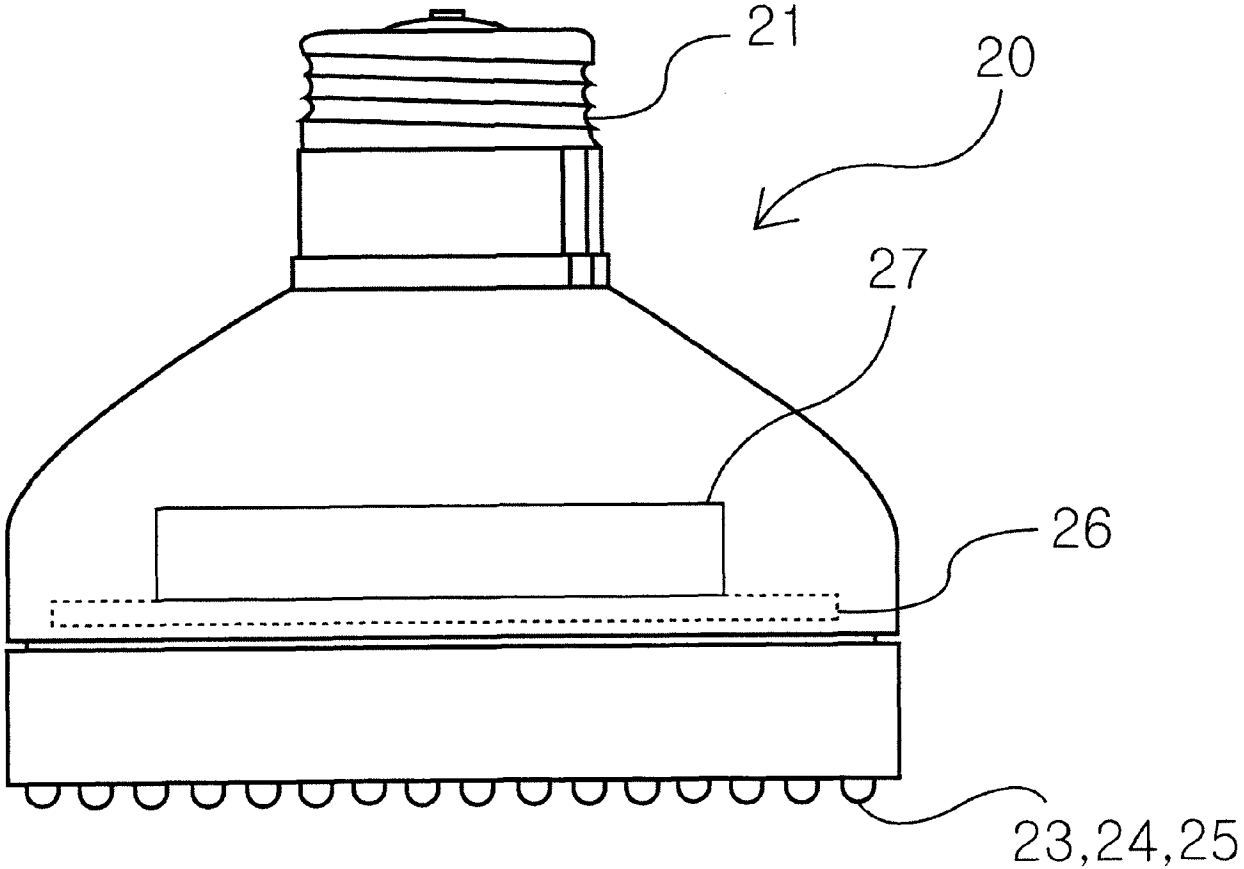
FIG. 10 is a side view of the incandescent lamp-type LED lighting apparatus to which the present invention has been applied.

Furthermore, as shown in FIG. 10, a driving unit 27 for driving LEDs 23, 24 and 25 is disposed on a substrate 26 inside the LED lamp 20, and AC power is supplied to the driving unit 27 via the base 21, and the terminals of the LEDs 1, 2 and 3 are connected to the substrate 26.

Here, the number and the intensity of the light of the LEDs 23, 24 and 25 are appropriately determined depending on the number of watts of the LED lamps 20 used and the desired color rendering and sharpness.

Now, when the LED lamp 20 as shown in FIGS. 9 and 10 is screwed into the socket of the incandescent lamp-type lighting apparatus (not shown), by means of the base 21 of the LED lamp 20 and then a user turns on the power, AC power is supplied to the driving unit 27 and the LEDs 23, 24 and 25 are all lighted up. The white-light LEDs 23 emits light having a wavelength distribution, such as that shown in FIG. 1, the LEDs 24 emits light having a peak value in a wavelength range of about 492 to 500 nm, and the LEDs 25 emit light having a peak value in a wavelength range of about 610 to 625 nm. As a whole, the LED lamp for the lighting apparatus using white-light LEDs, having a wavelength distribution, such as that shown in FIG. 8, is formed.

Furthermore, although in FIGS. 9 and 10, the LEDs 23, 24 and 25 have been illustrated as being mounted on the lower surface of the LED lamp 20 according to the present embodiment, at least some of the LEDs 23, 24 and 25 may be mounted on respective ends or circumferential surfaces of columns protruding from the lower surface, or may be mounted on the side circumferential surface of the LED lamp 20.

Meanwhile, although the incandescent lamp-type LED lamp has been described as an example of the LED lamp, it is possible to apply the substrate of the LED combination according to the present invention to a fluorescent lamp-type LED lamp, a substitute LED lamp for halogen lamp, and a substitute LED lamp for a Parabolic Aluminized Reflector (PAR) lamp.

In accordance with the above-described present invention, there can be provided a lighting apparatus that is capable of additionally outputting light of wavelengths which is not output by a lighting apparatus using white-light LEDs and which is used to enable the human optic nerves to perform their optic functionality under natural light conditions, thereby improving both color rendering and sharpness.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lighting apparatus comprising:

a plurality of light emitting diodes (LEDs) consisting of:

white LEDs, each of the white LEDs configured to emit light having a first peak value in a wavelength range of about 440 to 460 nm and a second peak value in a wavelength range of about 520 to 600 nm as a main light source, and first LEDs and second LEDs, both added in order to improve color rendering and sharpness of the white LEDs as the main light source, wherein each of the first LEDs is configured to emit light having a third peak value in a wavelength range of about 610 to 625 nm and functions as an auxiliary light source to the white LEDs, and wherein each of the second LEDs is configured to emit light having a fourth peak value in a wavelength range of about 492 to 500 nm and functions as an auxiliary light source to the white LEDs;

a substrate for allowing the white LEDs, the first LEDs, and the second LEDs to be disposed thereon;

a driving unit for driving the white LEDs, the first LEDs, and the second LEDs; and wires for connecting the substrate to the driving unit, wherein the first LEDs improve the color rendering of the white LEDs by increasing a color rendering index (CRI) of the plurality of LEDs to be greater than 90.

2. The lighting apparatus as set forth in claim 1, wherein the lighting apparatus is a movable lighting apparatus.

3. The lighting apparatus as set forth in claim 2, further comprising an anti-glare filter.

4. The lighting apparatus as set forth in claim 1, wherein the lighting apparatus is a stationary lighting apparatus.

5. The lighting apparatus as set forth in claim 1, wherein each of the first LEDs has only a single peak having the third peak value, and each of the second LEDs has only a single peak having the fourth peak value.

6. The lighting apparatus as set forth in claim 5, wherein each of the white LEDs has only two peaks having the first and second peak values.

7. The lighting apparatus as set forth in claim 6, wherein the CRI of the plurality of LEDs is between about 92 and 96.

8. A light emitting diode (LED) lamp comprising:

a plurality of LEDs consisting of:

white LEDs disposed on a lower surface of the LED lamp, each of the white LEDs configured to emit light having a first peak value in a wavelength range of about 440 to 460 nm and a second peak value in a wavelength range of about 520 to 600 nm as a main light source, and first LEDs and second LEDs, both added in order to improve color rendering and sharpness of the white LEDs as the main light source, wherein the first LEDs are disposed on the lower surface of the LED lamp, and each of the first LEDs is configured to emit light having a third peak value in a wavelength range of about 610 to 625 nm and functions as an auxiliary light source to the white LEDs, and wherein the second LEDs are disposed on the lower surface of the LED lamp, and each of the second LEDs is configured to emit light having a fourth peak value in a wavelength range of about 492 to 500 nm and functions as an auxiliary light source to the white LEDs;

a base configured to receive Alternating Current (AC) power;

a driving unit configured to drive the white LEDs, the first LEDs, and the second LEDs; and a substrate configured such that terminals of the white LEDs, the first LEDs and the second LEDs and the driving unit are disposed thereon and AC power is supplied by the base thereto, wherein the first LEDs improve the color rendering of the white LEDs by increasing a color rendering index (CRI) of the plurality of LEDs to be greater than 90.

9. The LED lamp as set forth in claim 8, wherein each of the first LEDs has only a single peak having the third peak value, and each of the second LEDs has only a single peak having the fourth peak value.

10. The LED lamp as set forth in claim 9, wherein each of the white LEDs has only two peaks having the first and second peak values.

11. The LED lamp as set forth in claim 10, wherein the CRI of the plurality of LEDs is between about 92 and 96.

* * * * *